United States Patent [19]

Suzuki et al.

[11] 4,080,226

[45] Mar. 21, 1978

[54] METHOD OF IMPROVING PLATING PROPERTIES OF MAGNETIC ALLOY MATERIALS CONTAINING NIOBIUM WITH AN ELECTRIC CONTACT MATERIAL

[75] Inventors: Yuichi Suzuki; Toshito Hara, both of Kawasaki, Japan

[73] Assignee: Fujitsu Limited, Japan

[21] Appl. No.: 608,992

[22] Filed: Aug. 29, 1975

Related U.S. Application Data

[63] Continuation-in-part of Ser. No. 281,644, Aug. 18, 1972, abandoned.

[30] Foreign Application Priority Data

Aug. 20, 1972 Japan ..... 46-63464

[51] Int. Cl.[2] ..... C25D 5/34; C25D 5/48; C23G 1/14; C21D 1/74

[52] U.S. Cl. ..... 148/20.3; 134/2; 156/625; 156/664; 204/32 R; 204/34; 427/62; 427/307

[58] Field of Search ..... 134/2; 29/194; 156/2, 156/625, 664; 204/29, 32 R, 34; 427/62, 307, 444; 148/20.3

[56] References Cited

U.S. PATENT DOCUMENTS

| | | | |
|---|---|---|---|
| 3,328,271 | 6/1967 | Kneip, Jr. et al. | 204/32 R |
| 3,553,015 | 1/1971 | Dohogne | 134/2 |

OTHER PUBLICATIONS

Cotton et al., *Advanced Inorganic Chemistry,* Interscience Publishers (1962); pp. 770 and 774, relied upon.

*Kirk-Othmer Encyclopedia of Chemical Technology,* 2nd Ed., (1969); vol. 13, p. 781, relied upon.

*Primary Examiner*—Barry S. Richman

*Attorney, Agent, or Firm*—Frailey & Ratner

[57] ABSTRACT

A niobium containing alloy amterial is initially annealed in a hydrogen atmosphere at a temperature approximating 700° C. The alloy material is then immersed in an aqueous solution of approximately between 1.0%–20.0% by weight of sodium hydroxide being maintained at a temperature of at least 70° C. Immersion of the alloy material in the aqueous solution removes niobium oxide which is formed in the surface portion of the alloy material during the annealing step. After removal of the alloy material from the aqueous solution, the alloy material is plated on its surface with an electric contact material.

7 Claims, 1 Drawing Figure

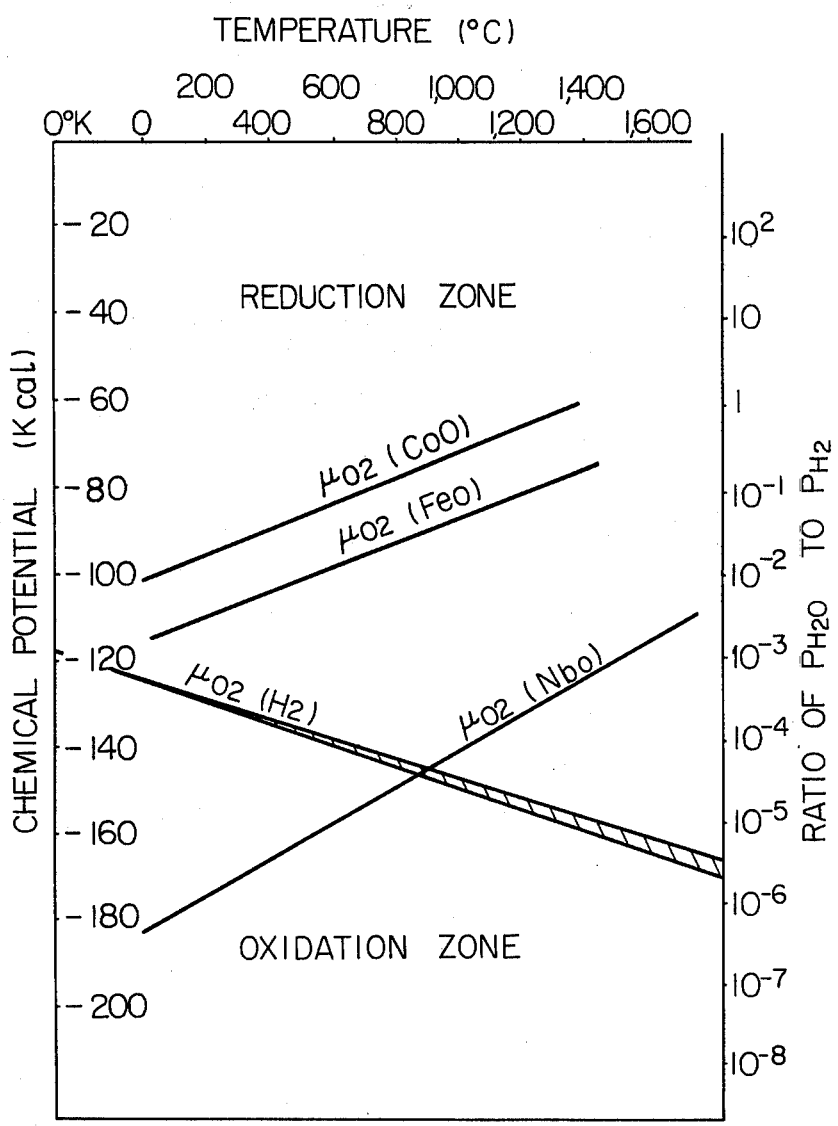
TEMPERATURE (°C)
0°K
0
200
400
600
800
1,000
1,200
1,400
1,600
CHEMICAL POTENTIAL (K cal)
-20
-40
-60
-80
-100
-120
-140
-160
-180
-200
REDUCTION ZONE
OXIDATION ZONE
μO2 (CoO)
μO2 (FeO)
μO2 (H2)
μO2 (Nbo)
RATIO OF PH2O TO PH2
10^2
10
1
10^-1
10^-2
10^-3
10^-4
10^-5
10^-6
10^-7
10^-8

METHOD OF IMPROVING PLATING PROPERTIES OF MAGNETIC ALLOY MATERIALS CONTAINING NIOBIUM WITH AN ELECTRIC CONTACT MATERIAL

CROSS REFERENCES TO RELATED APPLICATION

This patent application is a continuation-in-part of U.S. patent application Ser. No. 281,644, filed Aug. 18, 1972, now abandoned.

BACKGROUND OF THE INVENTION

A. Field of the Invention

This invention pertains to an improved method of plating niobium containing alloy material. In particular, this invention relates to a method of improving the plating properties of magnetic alloy materials containing niobium such that there is a high permanence of bond between an electric contact material plated to the surface of the niobium containing material. Still further, the instant invention relates to a method of cleaning niobium containing alloy materials prior to plating in order to eliminate niobium oxide formed on the surface of the material during the annealing of the alloy material in a reducing atmosphere.

B. Prior Art

It is known in the prior art that a semi-hard magnetic material maybe prepared by adding a small amount of niobium (in order of 1 to several percent) to parmalloy consisting of nickel and iron. It is also known in the prior art that such materials prepared in this matter are usable for producing wire memory elements and reed relay elements, particularly, latching reed relay elements. Such semi-hard magnetic materials have been found to have a high stiffness which may be utilized to form switch devices or connector elements. In these cases, the materials made of the semi-hard magnetic materials are usually plated with metals suitable for contact materials such as gold, silver, rhodium and other like elements as well as combinations thereof.

However, in such prior art, it has been difficult to place the semi-hard magnetic material containing niobium with sufficient binding permanence of the plated metal layer. In some prior cases, the semi-hard magnetic materials have usually been annealed at a high temperature in a hydrogen atmosphere. The annealing process has been found to result in the formation of a niobium oxide layer on the suface of the material. The niobium oxide layer has been found to provide a poor bond of the metal to the material surface.

In some prior cases, the reed elements of reed switch devices have been prepared from 52-alloy consisting of 52 parts by weight of nickel and 48 parts by weight of iron. In some prior processes, the reed element is annealed at a temperature of about 700° C for approximately 1 hour in a hydrogen atmosphere and the annealed element is then plated. Additionally, the reed element has in some prior cases been prepared from other semi-hard magnetic materials such as nibcolloy, consisting of 85 parts by weight of cobalt, 12 parts by weight of iron and 3 parts by weight of niobium. Due to the presence of the small amount of niobium, the nibcolloy has, in some cases, been found to have poor plating properties. This has been found true even when the nibcolloy material is annealed in a hydrogen atmosphere and thereafter plated under the same conditions as that of the 52-alloy. In such cases, it has been found that the metal layer plated unto the nibcolloy article has a high peeling tendency.

In contradistinction to such cases, other prior art alloys containing no niobium such as 52-alloy and an alloy consisting of 85 parts by way of cobalt and 15 parts by way of iron, have been found to have no peeling tendency even if they are plated after annealing under the same condition as that described for the nibcolloy. Therefore, it has been found in the prior processes that the high peeling tendency of the metal layer plated onto the nibcolloy material is derived from the presence of niobium therein. That is, a portion of niobium located on the surface of the material is converted to niobium oxide during the annealing at a high temperature. The niobium oxide layer thus formed results in a peeling tendency and a poor fixedness of the metal layer plated thereon.

It is known in the prior art that niobium oxide is soluble in hot aqueous alkali solution. However, such prior processes and systems are not believed to show that the treatment of hot aqueous alkali solutions to niobium containing magnetic alloy material improves the plating properties of such materials after the materials have been annealed in a hydrogen atmosphere.

Additionally, it is known in the prior art that when niobium pentoxide is reduced by hydrogen, lower oxides of niobium may be obtained. However, it is not believed that such prior systems and processes provide for the improved method of plating alloy materials consisting of niobium, cobalt and iron through annealing of the alloy materials in a predetermined atmosphere, and then following by immersing the alloy material in an aqueous solution of sodium hydroxide prior to the plating process as well hereinafter be described.

SUMMARY OF THE INVENTION

An improved method of plating alloy materials consisting of niobium, cobalt and iron which includes the initial step of annealing the alloy material in a hydrogen atmosphere at a temperature approximating 700° C. During the annealing step, niobium oxide is formed in a surface portion of the alloy material. The alloy material is then immersed in an aqueous solution of approximately 1.0%–20.0% by weight of sodium hydroxide at a temperature of at least 70° C. in order to remove the niobium oxide formed in the surface portion of the alloy material. The alloy material is then plated on the surface portion with an electric contact material.

An object of the instant invention is to provide an improved method of plating niobium containing alloy materials.

Another object of the present invention is to provide an improved method of plating alloy materials which includes the cleaning of niobium containing alloy materials to be plated subsequent to an annealing step wherein niobium oxide is formed on the surface of the alloy material.

A still further object of the subject invention is to provide a high bonding permanence of an electric contact material to the surface of a niobium containing alloy material.

Such objects of the present invention are accomplished by treating the niobium containing alloy material to be plated with an aqueous solution containing approximately between 1–20% by weight of sodium hydroxide at a temperature of at least 70° C. By the method of the present invention, niobium oxide produced on the surface of the material is completely eliminated. Thus, the material is imparted with a high permanence of bond with respect to other metal layers plated thereon.

Other features and advantages of the instant invention will become more apparent upon reading the detailed description set forth herein below and referring to the accompanying drawing.

BRIEF DESCRIPTION OF THE DRAWING

The FIGURE is a graph showing relationships between temperature and chemical potential of cobalt, iron and niobium in a hydrogen atmosphere.

DETAILED DESCRIPTION

The method of the present invention is applicable to improve the plating properties of niobium containing alloy materials. In particular, the present invention has wide application to improve the plating properties of alloy materials consisting of niobium, cobalt and iron which have been annealed at about 700° C in a hydrogen atmosphere. Such alloy materials are semi-hard magnetic materials. Magnetic properties of the materials are developed by the initial annealing process in a hydrogen atmosphere. Generally, alloy materials have good plating properties before they are subjected to the annealing process. However, after the completion of the annealing, the alloy materials have been found to have very poor plating properties. Thus, a metal layer plated onto the annealed alloy material has in many cases been found to have a very high peeling tendency.

In general, the annealing of the alloy material is carried out in a hydrogen atmosphere which is inert to the metal elements. Thus, it is difficult to suppose that during the annealing process, niobium oxide has been found to be formed on the surface portion of alloy materials. However, it has been found that during the aforementioned annealing process in a hydrogen atmosphere, that niobium oxide was found to be concentrated in the surface portion of the alloy material. It is not clearly understood whether fresh niobium oxide is formed during the annealing process in the hydrogen atmosphere or if niobium oxide in the alloy material migrates to the surface portion of the alloy material. However, from the discovery, the method for improving the plating property of the niobium containing alloy materials which have been annealed in a hydrogen atmosphere has been developed and will be presented in the following paragraphs.

In the drawing, the ordinate represents chemical potential of the metals and the abscissa represents temperature of the hydrogen atmosphere. The additional ordinate, located on the right side of the drawing, shows the ratio of partial pressure of steam ($PH_2O$) to partial pressure of hydrogen ($PH_2$) in the hydrogen atmosphere. The chemical potentials shown in the ordinate correspond to the ratio $PH_2O/PA_2$ on the additional ordinate.

At a temperature of 700° C, at which the nibcolloy materials are usually annealed, the chemical potentials of niobium oxide (NbO), cobalt oxide (CoO) and ferrous oxide (FeO) and oxygen in the hydrogen atmosphere are in the following relationships:

$$\mu O_2(NbO) < \mu O_2(H_2)$$

$$\mu O_2(CoO) > \mu O_2(H_2)$$

$$\mu O_2(FeO) > \mu O_2(H_2O)$$

wherein the $\mu O_2(H_2)$ represents chemical potential of high purity hydrogen (with a dew point of −60° to −70° C) under a pressure of 1 atmosphere. Accordingly, at 700° C, cobalt and iron are in the reduction zone, but niobium is in the oxidation zone in the drawing.

In order to enhance the permanance of bond of the metal layer plated onto the niobium-containing alloy article, it is important to eliminate niobium oxide produced on the surface of the material. Generally, in order to clean metallic materials to be plated, most materials are subjected to pickling with acid such as hydrochloric acid, nitric acid and sulfuric acid, and some of them are treated with potassium hydroxide.

However, it is impossible to completely eliminate niobium oxide by pickling with the acids or alkali as mentioned above. The niobium oxide produced on the niobium-containing alloy material can be eliminated by the method of the present invention using sodium hydroxide. This was proved by the following experiments.

A pure niobium material having niobium oxide layer on the surface thereof was treated with the acids or alkalis under the condition as shown in the table shown below. By the treatments, the niobium oxide was dissolved away at the rates as shown in the table.

| Item<br>Treating agent | Temperature (° C) | Time (day) | Dissolving rate ($g/cm^2/day$) |
|---|---|---|---|
| 20% hydrochloric acid | 21 | 82 | 0.00025 |
| Concentrated hydrochloric acid | 21 | .82 | 0.0006 |
| 20% sulfuric acid | 21 | 3650 | 0.00002 |
| 98% sulfuric acid | 21 | 3650 | 0.000056 |
| Nitric acid | 100 | 6 | 0 |
| 5% sodium hydroxide | 21 | 31 | 0.0066 |
| 5% sodium hydroxide | 100 | 5 | 13.0 |
| 5% potassium hydroxide | 21 | 31 | 0.0442 |
| 5% potassium hydroxide | 100 | 5 | 0.2744 |

The treating agent capable of dissolving away the niobium oxide was the sodium hydroxide solution at a high temperature, that is, 100° C.

In the method of the present invention, the niobium oxide produced on the niobium-containing alloy material to be plated, for example, the nibcolloy material annealed in hydrogen atmosphere at approximately 700° C for an hour, is cleaned by treating with an aqueous solution containing 1 to 20% by weight of sodium hydroxide at a temperature of 70° C or higher, preferably, the boiling point of the aqueous solution. After the treatment, the cleaned material is subjected to plating with gold, silver, rhodium and other desired metals. The material thus plated has an excellent permanence of bond with the metal layer. In the treatment, the niobium oxide on the material surface reacts with the sodium hydroxide and dissolves away into the solution.

If the concentration of the sodium hydroxide exceeds 20% by weight, the resultant reaction product has a high density which results in an undesirable high resistance to the dissolution. Also, if the sodium hydroxide is in a concentration lower than 1% by weight, it results in unsatisfactory dissolving away of the niobium oxide. Accordingly, it is important that the sodium hydroxide in the aqueous solution is in a concentration of 1 to 20% by weight. Unless the concentration of sodium hydroxide is in the range of 1 to 20% by weight, the dissolving rate of niobium oxide does not change with time lapse, and iron and cobalt in the alloy material are never affected.

In the method of the present invention, it is also important that the cleaning is carried out at a temperature not lower than 70° C. If the treating temperature is lower than 70° C, it is practically impossible to remove the niobium oxide from the alloy surface. In order to retain the temperature constant throughout the treatment, it is preferable that the treatment is effected at the boiling temperature of the aqueous solution.

Generally, the niobium oxide is produced during the annealing process in the hydrogen atmosphere. If the annealing for the niobium-containing alloy material is carried out in carbon monoxide atmosphere instead of the hydrogen atmosphere, it is very effective for preventing the conversion of niobium to niobium oxide.

The following example merely intends to illustrate the method of the present invention but not limit the scope thereof.

EXAMPLE

A nibcolloy material consisting of 85 parts by weight of cobalt, 12 parts by weight of iron and 3 parts by weight of niobium was annealed in hydrogen atmosphere at a temperature of 700° C for an hour. The material thus annealed was immersed into an aqueous solution containing 5% by weight of sodium hydroxide at the boiling point thereof for 18 minutes.

The material thus treated was subjected to plating with rhodium by the conventional procedure. The material had an excellent bond with rhodium and the plated rhodium layer has no peeling tendency.

For comparison, the same procedure as stated above was repeated at 60° C. The treated material had an insufficient bond with rhodium layer plated thereunto due to poor elimination of niobium oxide.

For another comparison, the same procedure as in this example was repeated using aqueous solutions containing 0.8% and 25% by weight of sodium hydroxide. Both the materials treated had a poor bond with the rhodium layer plated thereon.

What is claimed is:

1. A method of plating alloy materials consisting of niobium, cobalt, and iron comprising the steps of:

a. annealing said alloy material in a hydrogen atmosphere at a temperature of approximately 700° C., thereby forming niobium oxide in a surface portion of said alloy material;

b. immersing said alloy material in an aqueous solution of 1.0% to 20.0% by weight of sodium hydroxide at a temperature of at least 70° C. to remove said niobium oxide formed in said surface portion of said alloy material, said aqueous solution only containing a mixture of sodium hydroxide and water; and, c. plating said surface portion of said alloy material with an electric contact material.

2. The method of plating alloy materials as recited in claim 1 where the step of immersing includes the step of inserting said alloy material into said aqueous solution being maintained at the boiling point temperature of said aqueous solution.

3. The method of plating alloy materials as recited in claim 1 where said alloy materials are semi-hard magnetic materials.

4. The method of plating alloy materials as recited in claim 1 where said electric contact material is at least one element selected from the group consisting of gold, silver, rhodium and combinations thereof.

5. The method of plating alloy materials as recited in claim 1 wherein said step of annealing includes the step of maintaining said alloy material in said hydrogen atmosphere for approximately 1.0 hours.

6. The method of plating alloy materials as recited in claim 1 where said step of plating includes the step of bonding said electric contact material to said alloy material, said electric contact material and said alloy material having a high permanence of bond therebetween.

7. The method of plating alloy materials as recited in claim 1, wherein said aqueous solution contains 5.0% by weight of sodium hydroxide.

* * * * *

UNITED STATES PATENT OFFICE

CERTIFICATE OF CORRECTION

PATENT NO. : 4,080,226
DATED : March 21, 1978
INVENTOR(S) : Y. Suzuki et al

It is certified that error appears in the above-identified patent and that said Letters Patent are hereby corrected as shown below:

Page 1, line [30] change the Foreign Application Priority Date from "August 20, 1972" to --August 20, 1971--.

Signed and Sealed this

*Third* Day of *October 1978*

[SEAL]

*Attest:*

RUTH C. MASON
*Attesting Officer*

DONALD W. BANNER
*Commissioner of Patents and Trademarks*